US011527193B2

(12) United States Patent
Kim et al.

(10) Patent No.: US 11,527,193 B2
(45) Date of Patent: Dec. 13, 2022

(54) DISPLAY DRIVING APPARATUS

(71) Applicant: Silicon Works Co., Ltd., Daejeon (KR)

(72) Inventors: Young Bok Kim, Daejeon (KR); Taiming Piao, Daejeon (KR)

(73) Assignee: Silicon Works CO., Ltd, Daejeon (KR)

( * ) Notice: Subject to any disclaimer, the term of this patent is extended or adjusted under 35 U.S.C. 154(b) by 0 days.

(21) Appl. No.: 17/384,575

(22) Filed: Jul. 23, 2021

(65) Prior Publication Data

US 2022/0028324 A1 Jan. 27, 2022

(30) Foreign Application Priority Data

Jul. 23, 2020 (KR) ..... 10-2020-0091440

(51) Int. Cl.
*G09G 3/20* (2006.01)

(52) U.S. Cl.
CPC ... *G09G 3/2092* (2013.01); *G09G 2310/0291* (2013.01); *G09G 2330/021* (2013.01)

(58) Field of Classification Search
CPC ..... G09G 3/2092; G09G 2310/0291; G09G 2330/021; G09G 2310/0272; G09G 2340/16; G09G 3/36; G09G 3/32; G09G 2300/0828; G09G 2330/028
See application file for complete search history.

(56) References Cited

U.S. PATENT DOCUMENTS 7,863,982 B2 1/2011 Chen et al.
8,044,950 B2 10/2011 Satou
8,299,728 B2 * 10/2012 Nakao ..... G05F 1/56 315/307
8,941,697 B2 * 1/2015 Nathan ..... G09G 3/325 345/691
9,543,912 B2 1/2017 Lee
2002/0101172 A1 * 8/2002 Bu ..... G09G 3/325 315/169.3
2002/0180717 A1 * 12/2002 Ishiyama ..... H03K 5/2481 345/204
2003/0006955 A1 * 1/2003 Tsuchi ..... G09G 3/3688 345/92
2003/0038760 A1 * 2/2003 Kim ..... G09G 3/3241 345/76
2003/0080934 A1 * 5/2003 Ishiyama ..... G09G 3/3655 345/98
2005/0007325 A1 * 1/2005 Kim ..... G09G 3/3655 345/87

(Continued)

FOREIGN PATENT DOCUMENTS

KR 2015-0033161 A 4/2015
KR 2017-0005291 A 1/2017

*Primary Examiner* — Jose R Soto Lopez
(74) *Attorney, Agent, or Firm* — Polsinelli PC

(57) ABSTRACT

The present disclosure discloses a display driving apparatus in which the consumption power of a chip is optimized through control for each output channel of the chip. The display driving apparatus includes a consumption current control circuit for each output channel. The consumption current control circuit is configured to selectively provide a control current having a high current amount in order to drive an output voltage for the output side of an output buffer in response to a change in the pattern having a great difference between an input voltage and an output voltage.

12 Claims, 5 Drawing Sheets

(56) References Cited

U.S. PATENT DOCUMENTS

2006/0284815 A1* 12/2006 Kwon ..... G09G 3/3614 345/98
2007/0008253 A1* 1/2007 Nathan ..... G09G 3/3233 345/76
2007/0236420 A1* 10/2007 Huang ..... G09G 3/3216 345/76
2008/0024397 A1* 1/2008 Oomori ..... H03K 19/018528 345/60
2008/0024418 A1* 1/2008 Kim ..... G09G 3/3648 345/98
2008/0024709 A1* 1/2008 Moon ..... G09G 3/3688 349/139
2008/0129652 A1* 6/2008 Park ..... G09G 3/3648 345/55
2008/0180365 A1* 7/2008 Ozaki ..... G09G 3/3233 345/76
2008/0191987 A1* 8/2008 Lee ..... G09G 3/3614 345/95
2008/0238327 A1* 10/2008 Cho ..... G09G 3/3241 315/169.3
2009/0002405 A1* 1/2009 Ozaki ..... G09G 3/3283 345/690
2009/0046083 A1* 2/2009 Kim ..... G09G 3/20 345/204
2009/0295423 A1* 12/2009 Levey ..... G09G 3/3233 324/760.01
2010/0097360 A1* 4/2010 Cho ..... G09G 3/325 345/205
2010/0103082 A1* 4/2010 Levey ..... G09G 3/3233 345/76
2010/0156766 A1* 6/2010 Levey ..... G09G 3/3233 345/78
2011/0210958 A1* 9/2011 Yoo ..... G09G 3/325 345/76
2012/0300149 A1* 11/2012 Hsu ..... G02F 1/1368 349/43
2013/0100173 A1* 4/2013 Chaji ..... G09G 5/10 345/76
2013/0169619 A1* 7/2013 Jeong ..... G09G 5/001 345/212
2014/0152705 A1* 6/2014 Kwon ..... G09G 3/3275 345/77
2016/0155380 A1* 6/2016 Kwon ..... G09G 3/3233 345/78
2017/0047017 A1* 2/2017 Shirouzu ..... G09G 3/3266
2017/0236485 A1* 8/2017 Lee ..... G09G 3/3688 345/211
2018/0068611 A1* 3/2018 Chaji ..... G09G 3/3233
2018/0330797 A1* 11/2018 Chibashi ..... G09G 3/20
2021/0043145 A1* 2/2021 Li ..... H01L 27/3213

* cited by examiner

DISPLAY DRIVING APPARATUS

BACKGROUND

1. Technical Field

The present disclosure relates to a display driving apparatus, and more particularly, to a display driving apparatus in which the consumption power of a chip is optimized through control for each output channel of the chip.

2. Related Art

A display apparatus includes a display panel, such as an LCD panel or an LED panel for displaying a screen, and a display driving apparatus for driving the display panel.

Among the display panel and the display driving apparatus, the display driving apparatus is fabricated as a chip, that is, an integrated circuit, and is configured to process display data provided from the outside and provide the display panel with output voltages corresponding to the display data. The display panel may display a screen by the output voltages of the display driving apparatus.

In general, in the case of a high-resolution gaming notebook computer, a display driving apparatus is required to be developed by applying a low power driving technology.

The low power driving technology is implemented to control consumption power in a chip unit. In this case, consumption power of the display driving apparatus is set in a chip unit. Therefore, there is a difficulty in setting the display driving apparatus to have a consumption current optimized for each output channel.

Furthermore, the display driving apparatus of the gaming notebook computer needs to be set to have a high consumption current in order to improve a slew rate upon driving.

If the display driving apparatus is set to have a high consumption current in a chip unit, consumption power of the gaming notebook computer may greatly increase.

Accordingly, the display driving apparatus needs to be designed to optimize a consumption current for each output channel depending on a display pattern in order to effectively reduce consumption power.

SUMMARY

Various embodiments are directed to providing a display driving apparatus capable of optimizing a consumption current for each output channel and of performing low power driving for each output channel.

Also, various embodiments are directed to providing a display driving apparatus capable of controlling a driving current for each output channel depending on a driving pattern by selectively performing low power driving by determining an output change for each output channel.

In an embodiment, a display driving apparatus may include a plurality of output buffers configured to form output channels, and to output an output voltage corresponding to an input voltage, respectively, and a plurality of consumption current control circuits configured for the respective output channels. Each of the consumption current control circuits provides a control current to an output side of a corresponding output buffer when a difference between the input voltage and the output voltage is equal to or greater than a preset reference value.

In an embodiment, a display driving apparatus may include an output buffer configured to form an output channel and output an output voltage corresponding to an input voltage, a current control unit configured to provide a control signal corresponding to a difference between the input voltage and the output voltage, and a current setting unit configured to provide a control current to an output side of the output buffer in response to the control signal when the difference is equal to or greater than a preset reference value.

The display driving apparatus of the present disclosure can reduce consumption power in a chip unit because it can perform low power driving for each output channel consisting of the output buffer.

Furthermore, the display driving apparatus of the present disclosure can control a driving current for each output channel depending on a driving pattern and perform low power driving having a consumption current optimized for each output channel.

Furthermore, the display driving apparatus of the present disclosure can control a driving current for each output channel by determining a difference between an input voltage and an output voltage, and have a consumption current optimized for each output channel of a chip.

DETAILED DESCRIPTION

A display driving apparatus of the present disclosure is configured to provide output voltages with a display panel (not illustrated) for displaying a screen.

To this end, the display driving apparatus is fabricated as an integrated circuit, and has a plurality of output channels for outputting the output voltages. The display driving apparatus receives display data from the outside (e.g., a timing controller, etc.), and outputs output voltages corresponding to the display data through the plurality of output channels.

Figure 1:
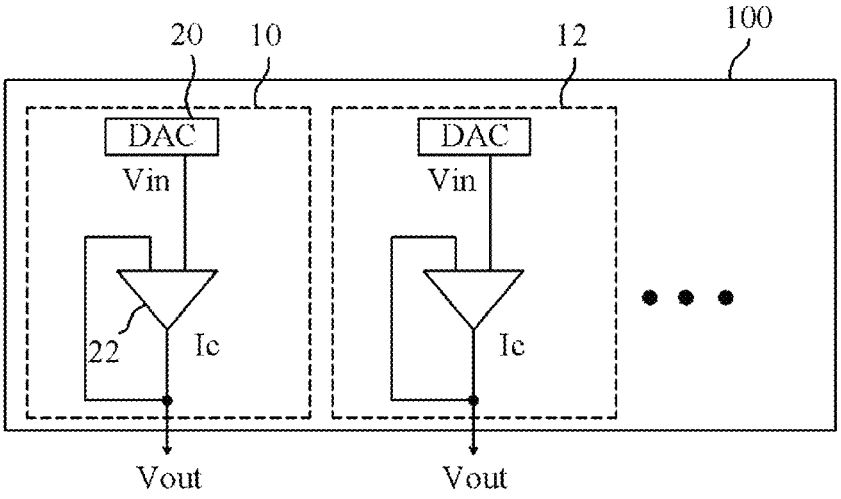
FIG. 1 is a block diagram illustrating a display driving apparatus in which the present disclosure is implemented.

FIG. 1 illustrates an example in which a display driving apparatus 100 has a plurality of output channels 10, 12, . . .

The display driving apparatus 100 may include the plurality of output channels 10, 12, . . . for outputting output voltages corresponding to display data as illustrated in FIG. 1.

In FIG. 1, it may be understood that the output channels 10, 12, . . . have the same structure. Therefore, detailed configurations of the output channels 10, 12, . . . are described with reference to the output channel 10 as a representative, and redundant illustration and redundant description of the output channels are omitted.

The display driving apparatus 100 is configured to output an output voltage Vout corresponding to display data through each of the output channels 10, 12, . . .

To this end, each of the output channels 10, 12, . . . may include a digital-to-analog converter (DAC) 20 and an output buffer 22.

The display driving apparatus 100 may include parts for digital processing for receiving and processing display data. That is, the display driving apparatus 100 may include a latch unit (not illustrated) for in parallel arranging display data that is received in series and a level shifter (not illustrated) for shifting levels of the arranged display data and providing the DAC 20 with the display data whose levels are shifted. However, the parts for the digital processing are omitted from FIG. 1 for convenience of description of an embodiment of the present disclosure.

The DAC 20 is configured to receive display data corresponding to the output channel 10, select an analog voltage corresponding to the display data, and output the selected analog voltage. More specifically, the DAC 20 may be configured to receive a plurality of gamma voltages (not illustrated), select a gamma voltage corresponding to display data, and output the selected gamma voltage as an analog voltage.

In this case, the analog voltage output by the DAC 20 corresponds to an input voltage of the output buffer 22 to be described later, and is indicated as an input voltage Vin.

The output buffer 22 is configured to output the output voltage Vout corresponding to the input voltage Vin. The output buffer 22 is configured for each of the output channels 10, 12, . . . Therefore, it may be understood that the display driving apparatus 100 includes the output buffer for each output channel and outputs a plurality of output voltages Vout through a plurality of output channels.

More specifically, the output buffer 22 receives the input voltage Vin and a fed-back output voltage Vout. For example, the input voltage Vin may be input to a positive input stage (not illustrated) of the output buffer 22. The fed-back output voltage Vout may be input to a negative input stage (not illustrated) of the output buffer 22.

The output buffer 22 is configured to internally generate driving currents corresponding to the input voltage Vin and the fed-back output voltage Vout and output the output voltage Vout corresponding to the driving currents.

Figure 2:
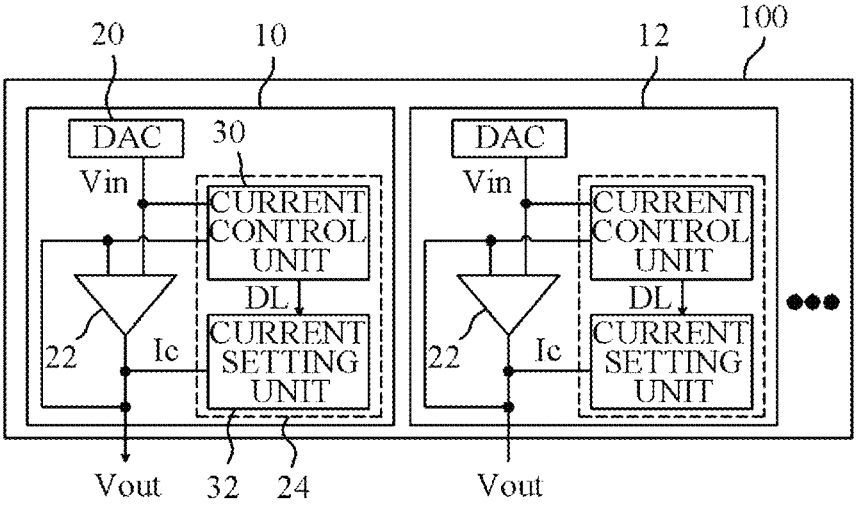
FIG. 2 is a block diagram illustrating a display driving apparatus according to a preferred embodiment of the present disclosure.

A display driving apparatus of the present disclosure may be implemented as in FIG. 2, in order to optimize a consumption current for each output channel and to perform low power driving. FIG. 2 illustrates that a consumption current control circuit 24 is configured. In FIG. 2, a DAC 20 and an output buffer 22 have the same configuration and operate in the same manner as those of FIG. 1, and redundant descriptions thereof are omitted.

The consumption current control circuit 24 is configured for each of the output channels 10, 12, . . .

The consumption current control circuit 24 is configured to provide a control current Ic to the output side of the output buffer 22 when a difference between the input voltage Vin and the output voltage Vout is equal to or greater than a preset reference value.

When the output voltage Vout is greatly changed in a consecutive N-th horizontal cycle and (N−1)-th horizontal cycle, it may be determined that the output voltage Vout of a specific pixel of a display panel is changed in order to represent a dynamic pattern having a severe change in brightness. Furthermore, when the output voltage Vout is small changed in a consecutive N-th horizontal cycle and (N−1)-th horizontal cycle, it may be determined that the output voltage Vout of a specific pixel of a display panel is changed in order to represent a static pattern having a small change in brightness. It may be understood that N is a natural number and the output voltage Vout in the N-th horizontal cycle corresponds to the input voltage Vin in a current horizontal cycle. It may be understood that the output voltage Vout in the (N−1)-th horizontal cycle corresponds to the input voltage Vin in a previous horizontal cycle.

It may be understood that the reference value is a value preset in order to distinguish between the static pattern and the dynamic pattern. The reference value may be set as an absolute value of a difference between a preset input voltage Vin and the output voltage Vout.

The consumption current control circuit 24 is configured not to provide the control current Ic to the output side of the output buffer 22 in a first case where a difference between the input voltage Vin and the output voltage Vout is smaller than the reference value, and to provide the control current Ic to the output side of the output buffer 22 in order to drive the output voltage Vout in a second case where the difference between the input voltage Vin and the output voltage Vout is equal to or greater than the reference value.

In this case, it is preferred that the control current Ic is provided to have a current amount having a higher absolute value than a driving current of the output buffer 22.

To this end, the consumption current control circuit 24 may be configured to include a current control unit 30 and a current setting unit 32.

The current control unit 30 is configured to provide a control signal DL corresponding to a difference between the input voltage Vin and the output voltage Vout.

Furthermore, the current setting unit 32 includes a positive current source IR and a negative current source IF. The current setting unit 32 is configured not to provide the control current Ic in response to the control signal DL when a difference between the input voltage Vin and the output voltage Vout is smaller than the reference value, and to provide the control current Ic from the positive current source IR or the negative current source IF to the output side of the output buffer 22 in response to the control signal DL when a difference between the input voltage Vin and the output voltage Vout is equal to or greater than the reference value.

Figure 3:
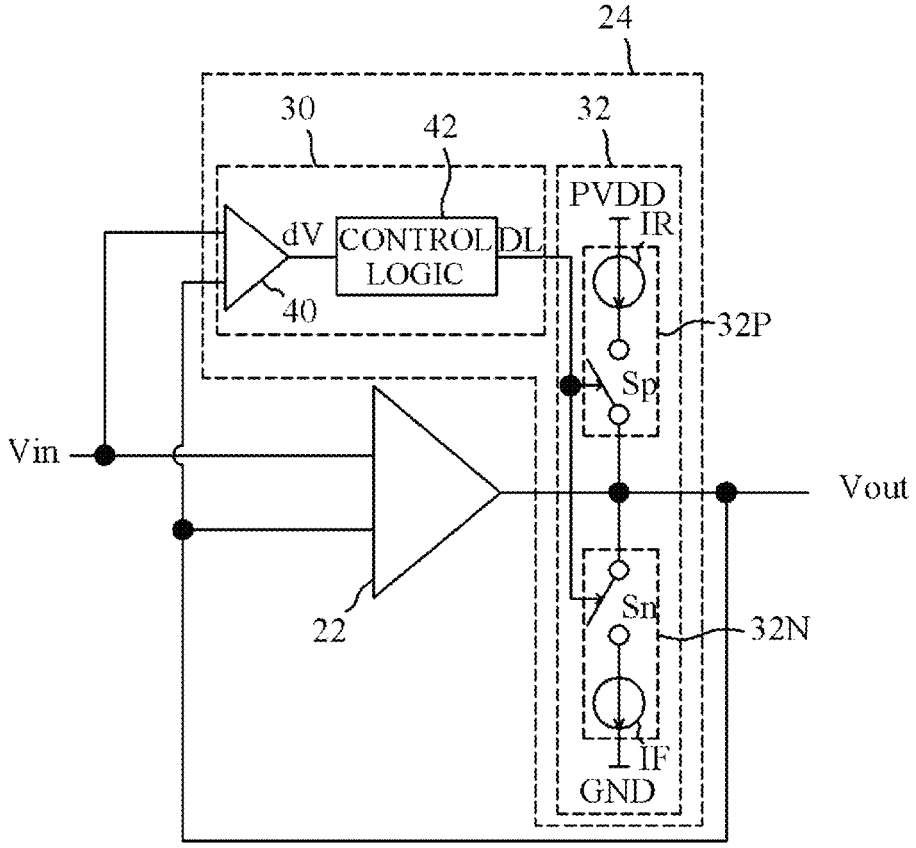
FIG. 3 is a block diagram illustrating a consumption current control circuit of FIG. 2.
Figure 4:
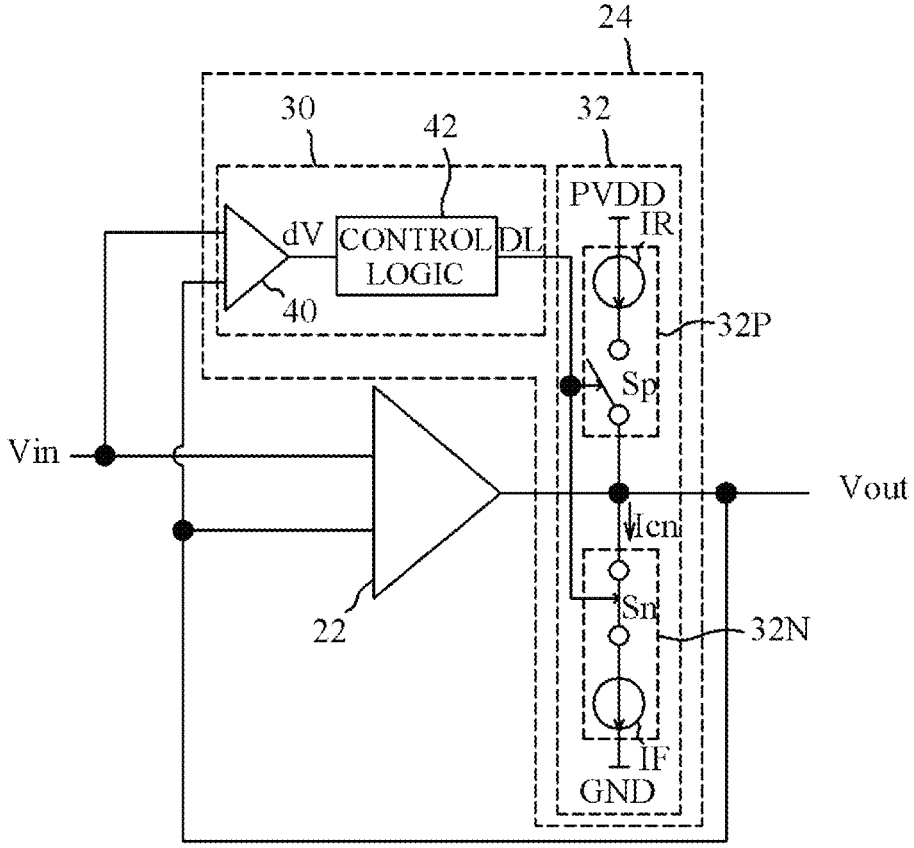
FIGS. 4 and 5 are block diagrams illustrating the state in which the consumption current control circuit of FIG. 2 outputs a control current.
Figure 5:
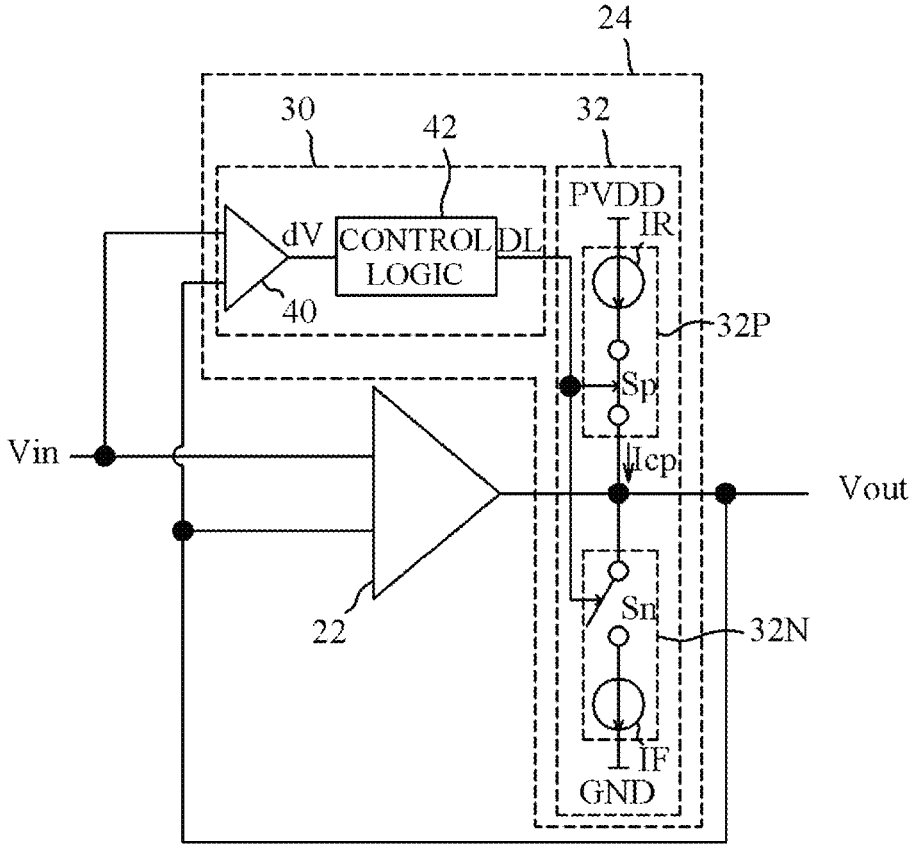

A detailed embodiment of the consumption current control circuit 24 is described with reference to FIGS. 3 to 5. FIG. 3 illustrates the consumption current control circuit 24, and illustrates the state in which a positive switch Sp and a negative switch Sn are turned off and the control current Ic is not provided to the output side of the output buffer 22. FIG. 4 illustrates that the consumption current control circuit 24 of FIG. 3 provides a control current Icn having a negative component through the negative switch Sn that is turned on. FIG. 5 illustrates that the consumption current control circuit 24 of FIG. 3 provides a control current Icp having a positive component through the positive switch Sp that is turned on. In FIGS. 4 and 5, the control current Icn and the control current Icp are used to distinguish between a positive component and a negative component. In the following description, the control current Ic is used for commonly calling the control currents Icn and Icp of FIGS. 4 and 5.

First, the current control unit 30 is configured to include a comparator 40 and control logic 42.

The comparator 40 is configured to compare the input voltage Vin and a fed-back output voltage Vout and to output a comparison signal dV corresponding to a difference between the input voltage Vin and the fed-back output voltage Vout. The comparator 40 may be configured to include a comparison amplifier configured to output the comparison signal dV corresponding to the difference between the input voltage Vin and the fed-back output voltage Vout or the comparison signal dV having a high level when the difference between the input voltage Vin and the fed-back output voltage Vout is equal to or greater than an internal offset voltage.

The control logic 42 may be configured to receive the comparison signal dV and to provide the control signals DL having different levels when the difference between the input voltage Vin and the fed-back output voltage Vout is smaller than the reference value and when the difference is equal to or greater than the reference value. In this case, the reference value may be defined by an internal reference voltage. Furthermore, the control signal DL may be output to have a high level when the level of the comparison signal dV is higher than the reference voltage, and may be output to have a low level when the level of the comparison signal dV is lower than the reference voltage.

By the configuration of the current control unit 30, when the difference between the input voltage Vin and the fed-back output voltage Vout is small, the comparator 40 may output the comparison signal dV having a low level, and the control logic 42 may output the control signal DL having a low level. In contrast, when the difference between the input voltage Vin and the fed-back output voltage Vout is great, the comparator 40 may output the comparison signal dV having a high level, and the control logic 42 may output the control signal DL having a high level.

The current setting unit 32 may determine the difference between the input voltage Vin and the fed-back output voltage Vout in response to the control signal DL. When the difference between the input voltage Vin and the fed-back output voltage Vout is smaller than the reference value, the current setting unit 32 blocks the control current Ic from being supplied from the positive current source IR and the negative current source IF to the output side of the output buffer 22, in response to the control signal DL. Furthermore, when the difference between the input voltage Vin and the fed-back output voltage Vout is equal to or greater than the reference value, the current setting unit 32 supplies the control current Ic from the positive current source IR or the negative current source IF to the output side of the output buffer 22, in response to the control signal DL. In this case, a current amount of the control current Ic may have an absolute value very higher than that of a driving current of the output buffer 22.

To this end, the current setting unit 32 includes a positive current circuit 32P and a negative current circuit 32N. The positive current circuit 32P includes the positive current source IR and the positive switch Sp. The negative current circuit 32N includes the negative current source IF and the negative switch Sn.

The positive current source IR functions as a current source that provides the control current Icp corresponding to a driving voltage PVDD and having a positive component. The negative current source IF functions as a current source that provides the control current Icn corresponding to a ground voltage GND and having a negative component.

Furthermore, the positive switch Sp is configured to switch coupling between the positive current source IR and the output side of the output buffer 22 in response to the control signal DL. The negative switch Sn is configured to switch coupling between the negative current source IF and the output side of the output buffer 22 in response to the control signal DL. In this case, it may be understood that the output side of the output buffer 22 means a node coupled to an output stage of the output channel.

By means of the configuration, the current setting unit 32 may provide the control current Ic to the output side of the output buffer 22 as the positive switch Sp or the negative switch Sn is turned on in response to the control signal DL.

It may be understood that the current setting unit 32 uses the driving voltage PVDD and the ground voltage GND having a great potential difference than an operating voltage and a ground voltage provided for an operation of the output buffer 22. Accordingly, it may be understood that the current setting unit 32 is a circuit that additionally provides the output side of the output buffer 22 with the control current Ic having a high current amount in order to drive the output voltage Vout when being activated in response to the control signal DL.

When being driven by the control current Ic having a high current amount which is added by the current setting unit 32, the output voltage Vout may rapidly rise at rising timing and rapidly fall at falling timing. That is, the output voltage Vout may have a slew rate improved to drive a gaming notebook computer, etc. by a high consumption current.

In the case of the static pattern in which a pattern change of the output channel 10 is not great, the positive switch Sp and the negative switch Sn are turned off as in FIG. 3. At this time, the output channel 10 may output the output voltage Vout with a low consumption current because the output channel 10 is not provided with the control current Ic of the current setting unit 32 and drives the output voltage Vout by the output buffer 22.

In the case of the dynamic pattern in which a pattern change of the output channel 10 is great, the positive switch Sp or the negative switch Sn is turned on as in FIG. 4 or 5. At this time, the output channel 10 may output the output voltage Vout with a high consumption current because the output channel 10 drives the output voltage Vout while being provided with the control current Ic of the current setting unit 32. In this case, the output voltage Vout may have an improved slew rate.

In an embodiment of the present disclosure, the display driving apparatus 100 is set to drive the output voltage Vout with a great current amount for the respective output channels, each having the output buffer configured therein, by the switching of the positive switch Sp and the negative switch Sn only in the case of the dynamic pattern in which a pattern change is great. The display driving apparatus 100 is set to drive the output voltage Vout with a small current amount for each output channel in the case of the static pattern in which a pattern change is not great. Therefore, in the embodiment of the present disclosure, the display driving apparatus 100 can reduce consumption power in a chip unit because it selectively drives the output voltage Vout with a great current amount only for a required output channel.

Furthermore, in an embodiment of the present disclosure, the display driving apparatus 100 can control a driving current for each output channel and have a consumption current optimized for each output channel, by changing the switching of the positive switch Sp and the negative switch Sn depending on a driving pattern.

Furthermore, in an embodiment of the present disclosure, the display driving apparatus 100 can control a driving current for each output channel and have a consumption current optimized for each output channel of a chip by determining the difference between the input voltage Vin and the output voltage Vout, which corresponds to a change in the driving pattern.

In an embodiment of the present disclosure, unlike the embodiments of FIGS. 3 to 5, the display driving apparatus 100 may be configured so that the activation and deactivation of the positive current source IR and the negative current source IF are controlled in response to the control signal DL. In this case, the display driving apparatus 100 includes the positive current source IR whose current supply is controlled in response to the control signal DL and the negative current source IF whose current supply is controlled in response to the control signal DL. The display driving apparatus 100 may provide the control current Ic to the output side of the output buffer 22 by the positive current source IR or the negative current source IF activated in response to the control signal DL.

Figure 6:
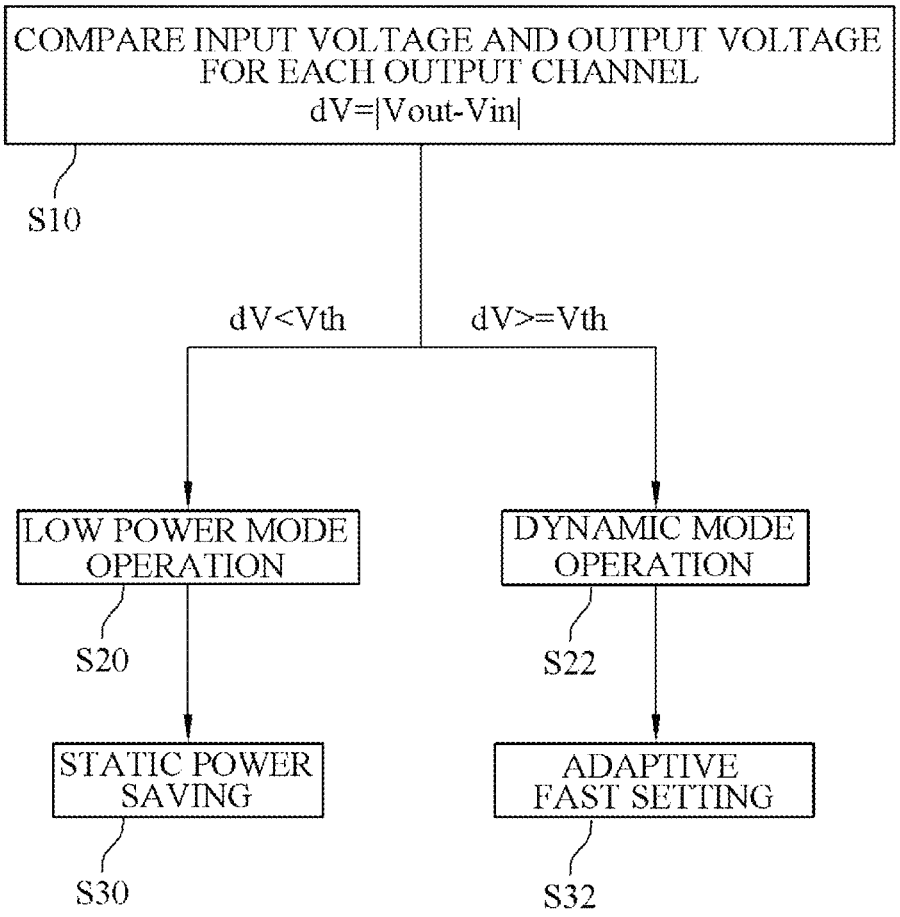
FIG. 6 is a flowchart for describing low power driving for each output channel.

The display driving apparatus of the present disclosure implemented as in FIGS. 1 to 5 controls a driving current of the output buffer 22 based on setting for each channel by using a method of FIG. 6.

That is, the comparator 40 compares the input voltage Vin and the output voltage Vout for each output channel (S10). In this case, a difference dV between the input voltage Vin and the output voltage Vout may be represented as an absolute value. The absolute value may be represented by Equation $dV=|Vout-Vin|$.

When the difference dV between the input voltage Vin and the output voltage Vout is smaller than a reference value Vth, an output channel of the display driving apparatus 100 may perform a low power mode operation S20 corresponding to the static pattern and then perform static power saving S30. It may be understood that the low power mode operation S20 corresponds to a case where the control current Ic is blocked from being provided from the positive current source IR and the negative current source IF to the output side of the output buffer 22 as illustrated in FIG. 3, and is an operation of reducing a consumption current.

When the difference dV between the input voltage Vin and the output voltage Vout is equal to or greater than the reference value Vth, the output channel of the display driving apparatus 100 may perform a dynamic mode operation S22 corresponding to the dynamic pattern and then perform adaptive fast setting S32. It may be understood that the dynamic mode operation S22 corresponds to a case where the control current Ic is provided from the positive current source IR or the negative current source IF to the output side of the output buffer 22 as illustrated in FIGS. 4 and 4, and is an operation of performing setting, such as precharge, in order to drive the output voltage Vout with a high consumption current.

The display driving apparatus of the present disclosure can be set to reduce consumption power in a chip unit and to have consumption power optimized for each output channel because low power driving can be selectively controlled for each output channel as described above.

Furthermore, the display driving apparatus of the present disclosure can control a driving current for each output channel by determining a pattern change, that is, a difference between an input voltage and an output voltage.

Therefore, the display driving apparatus of the present disclosure can set consumption power for each output channel in a way to have a high consumption current in order to improve a slew rate while having a consumption current optimized for each output channel.

Accordingly, the display driving apparatus can reduce consumption power in a chip unit by the setting of consumption power for each output channel.

What is claimed is:

1. A display driving apparatus comprising:

a plurality of output buffers configured to form output channels, and to output an output voltage in a previous horizontal cycle corresponding to an input voltage in a current horizontal cycle, respectively; and a plurality of consumption current control circuits configured for the respective output channels, wherein each of the consumption current control circuits provides a control current to an output side of a corresponding output buffer when a difference between the input voltage and the output voltage is equal to or greater than a preset reference value, and wherein the consumption current control circuit comprises:

a current control unit configured to provide a control signal corresponding to the difference, and a current setting unit comprising a positive current source and a negative current source and configured to provide the control current from the positive current source or the negative current source to the output side of the output buffer in response to the control signal when the different is equal to or greater than the reference value.

2. The display driving apparatus of claim 1, wherein the current control unit comprises:

a comparator configured to output a comparison signal corresponding to the difference; and control logic configured to receive the comparison signal and provide the control signals having different levels in accordance with a case where the difference is smaller than the reference value and a case where the difference is equal to or greater than the reference value.

3. The display driving apparatus of claim 1, wherein the current setting unit blocks the control current from being provided from the positive current source and the negative current source to the output side of the output buffer, in response to the control signal when the difference is smaller than the reference value; and provides the control current from the positive current source or the negative current source to the output side of the output buffer, in response to the control signal when the difference is equal to or greater than the reference value.

4. The display driving apparatus of claim 1, wherein the current setting unit comprises:

the positive current source;

a positive switch configured to switch coupling between the positive current source and the output side of the output buffer in response to the control signal;

the negative current source; and a negative switch configured to switch coupling between the negative current source and the output side of the output buffer in response to the control signal, and wherein the current setting unit provides the control current to the output side of the output buffer by the positive switch turned on or the negative switch turned on in response to the control signal.

5. The display driving apparatus of claim 1, wherein the current setting unit comprises:

the positive current source whose current supply is controlled in response to the control signal; and the negative current source whose current supply is controlled in response to the control signal, and wherein the current setting unit provides the control current by the positive current source or the negative current source to the output side of the output buffer in response to the control signal.

6. The display driving apparatus of claim 1, wherein the control current has a current amount having a higher absolute value than a driving current of the output buffer.

7. A display driving apparatus comprising:

an output buffer configured to form an output channel and output an output voltage in a previous horizontal cycle corresponding to an input voltage in a current horizontal cycle;

a current control unit configured to provide a control signal corresponding to a difference between the input voltage and the output voltage; and a current setting unit configured to provide a control current to an output side of the output buffer in response to the control signal when the difference is equal to or greater than a preset reference value, wherein the current control unit comprises:

a comparator configured to output a comparison signal corresponding to the difference, and control logic configured to receive the comparison signal and provide the control signals having different levels in accordance with a case where the difference is smaller than the reference value and a case where the difference is equal to or greater than the reference value.

8. The display driving apparatus of claim 7, wherein the current setting unit comprises a positive current source and a negative current source, and provides the control current from the positive current source or the negative current source to the output side of the output buffer in response to the control signal.

9. The display driving apparatus of claim 8, wherein the current setting unit blocks the control current from being provided from the positive current source and the negative current source to the output side of the output buffer, in response to the control signal when the difference is smaller than the reference value; and provides the control current from the positive current source or the negative current source to the output side of the output buffer, in response to the control signal when the difference is equal to or greater than the reference value.

10. The display driving apparatus of claim 9, wherein the current setting unit comprises:

the positive current source;

a positive switch configured to switch coupling between the positive current source and the output side of the output buffer in response to the control signal;

the negative current source; and a negative switch configured to switch coupling between the negative current source and the output side of the output buffer in response to the control signal, and wherein the current setting unit provides the control current to the output side of the output buffer by the positive switch turned on or the negative switch turned on in response to the control signal.

11. The display driving apparatus of claim 9, wherein the current setting unit comprises:

the positive current source whose current supply is controlled in response to the control signal; and the negative current source whose current supply is controlled in response to the control signal, and wherein the current setting unit provides the control current by the positive current source or the negative current source to the output side of the output buffer in response to the control signal.

12. The display driving apparatus of claim 7, wherein the control current has a current amount having a higher absolute value than a driving current of the output buffer.

* * * * *